United States Patent [19]

Skobel

[11] 4,286,360

[45] Sep. 1, 1981

[54] JEWELRY CLASP

[75] Inventor: Max Skobel, Edison, N.J.

[73] Assignee: Laurel Enterprises, Rahway, N.J.

[21] Appl. No.: 128,839

[22] Filed: Mar. 10, 1980

[51] Int. Cl.[3] ..... A44C 5/18; A44B 17/00

[52] U.S. Cl. ..... 24/230 R; 24/265 R; 24/299; 59/93; 63/2; 224/166; 224/267

[58] Field of Search ..... 24/230 R, 265 EC, 265 R, 24/201 A, 73 J, 265 A; 63/2, 3, 4; 59/93; 224/166, 267

[56] References Cited

U.S. PATENT DOCUMENTS 4,001,923 1/1977 Frankel et al. ..... 24/230 R

*Primary Examiner*—Roy D. Frazier
*Assistant Examiner*—Alexander Grosz
*Attorney, Agent, or Firm*—Friedman, Goodman & Teitelbaum

[57] ABSTRACT

A jewelry clasp having a male member adapted to be inserted into an opening in a female member, and the female member including a releasable locking mechanism clasping the male and female members together, wherein a retaining guard is releasably placed onto the male member for preventing jewelry from sliding off the male member. The thickness of both the female member and the retaining guard being greater than the diameter of the opening of the jewelry which receives a chain therethrough. The male member can be used to thread beads, or other jewelry onto the chain with the retaining guard then being placed on the male member so that the beads or other jewelry will not slip off the chain.

10 Claims, 8 Drawing Figures

JEWELRY CLASP

BACKGROUND OF THE INVENTION

This invention relates to a jewelry clasp, and more particularly to a jewelry clasp permitting the addition of pieces of jewelry onto a chain while preventing the jewelry from accidentally sliding off the chain.

Numerous jewelry clasps are presently in use to secure the ends of a chain together. Such chains can be part of necklaces, bracelets, or other similar articles of jewelry. One specific type of jewelry clasp is described in U.S. Pat. No. 4,001,923 issued on Jan. 11, 1977. In that patent there is described a clasp having a male and a female member which are adapted to be clasped together by releasable locking means engaging the male member to hold it within the female member. The locking means is disposed in the female member and includes an integral one piece member having a locking portion for engaging the male member, a resilient portion for biasing a locking portion against the male member, and an actuating portion for moving the locking portion relative to the pressure of the resilient portion for releasing the male member, to thereby permit retraction thereof from the female member. The female member also includes holding means to position the resilient portion relative to the female member.

In the aforementioned jewelry clasp, the clasp is simple to operate and provides for the positive locking together of the male and female members. The construction is simplified and it avoids accidental retraction of the male member from the female member.

One problem with prior art jewelry clasps, concerns the ability to add pieces of jewelry onto a chain. Specifically, it is frequently desired to add additional pieces of jewelry or to remove specific ones of the jewelry pieces. Many chains include beads which can be added or removed from the chain. Similarly, it may be desired to add or remove a specific locket, pendant, or other piece of jewelry from a necklace.

Since the chain is a continuous interconnected strand, it is often difficult, if not impossible, to open the chain to add or remove specific ones of the jewelry. It is therefore necessary to add and remove the pieces of jewelry from the clasped section. In order to do that, one of the members, frequently the male member, is made thin enough to pass through the diameter of the piece of jewelry. In this way, the male member is used as a needle or finger to thread the chain through the openings in the jewelry. However, this requires that the size of the male member be smaller than the opening in the jewelry. As a result, when the male member is separated from the female member, during the time that the clasp is open either intentionally or accidentally, it is possible that the pieces of jewelry can slide off the chain by passing over the male member.

Accordingly, it is desirous to have a jewelry clasp which includes a male member which is small enough to pass through the openings in jewelry so that the jewelry can be threaded onto the chain, and at the same time include means for preventing the jewelry from accidentally sliding off the chain.

SUMMARY OF THE INVENTION

Accordingly, it is an object of the present invention to provide a jewelry clasp which avoids the aforementioned problems of prior art devices.

Another object of the present invention is to provide a jewelry clasp which includes a retaining guard for preventing jewelry from sliding off the clasp.

A further object of the present invention is to provide a jewelry clasp which includes a male and female member with a retaining guard releasably engaging the male member.

Still another object of the present invention is to provide a jewelry clasp including a retaining member which can easily slide onto and off of a male member, thereby permitting the male member to be used for threading additional pieces of jewelry onto the chain, as desired.

An added object of the present invention is to provide a jewelry clasp having simplified construction which may be manufactured easily and economically and includes a retaining guard releasably coupled onto a portion of the clasp for preventing pieces of jewelry from sliding off of the chain.

Briefly, in accordance with the present invention, there is provided a jewelry clasp including a female member having an opening therein. A male member is adapted to be inserted into the female member through the opening. A releasable locking mechanism is provided for clamping the male and female members together. A retaining guard releasably engages the male member thereby preventing jewelry from sliding off the male member.

In a preferred embodiment of the invention, the retaining guard is formed of a folded-over piece of rigid material to form a pair of confronting winged sections, which are resilient and separable under pressure for the entry and removal of the male member therefrom.

Recesses formed in the confronting walls of the winged sections form an elongated channel which receives the male member. Angular projections extend from the winged sections into the channel and engages a notch formed in the male member, thereby retaining the male member within the retaining guard.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DETAILED DESCRIPTION OF THE PREFERRED EMBODIMENT

Figure 1:
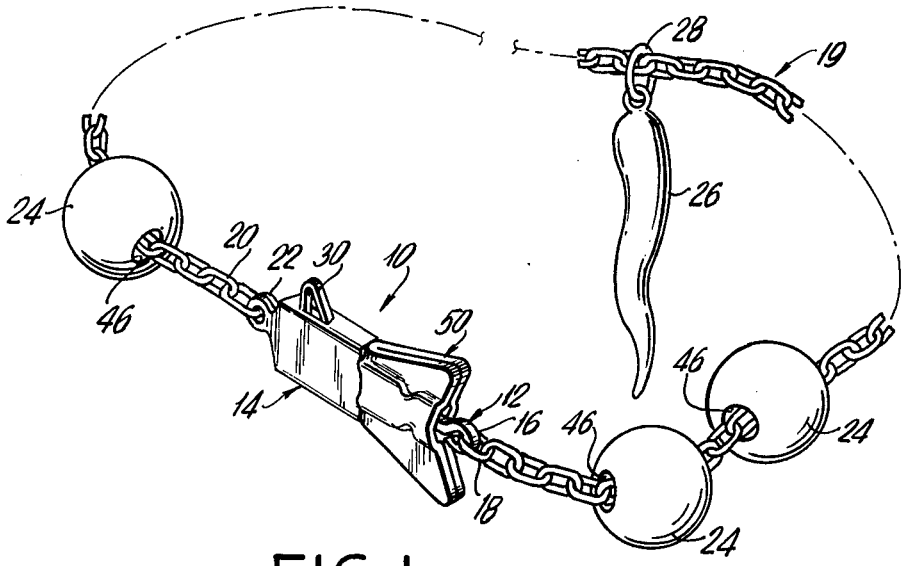
FIG. 1 is a perspective view of a jewelry clasp connected to a chain having pieces of jewelry thereon in accordance with the present invention.

Referring now to FIG. 1, the jewelry clasp 10 of the present invention is shown in a locked position. The jewelry clasp includes a male member 12 which is inserted into a female member 14. At the rear of the male member there is included a loop or ring 16 to which is connected one end loop 18 of a chain 19. The other end loop 20 of the chain 19 is connected to a similar loop or ring 22 formed at the rear of the female member 14. On the chain 19 there are specific pieces of jewelry including the beads 24 as well as an ornament, such as a tooth 26, held onto the chain by means of a retaining loop 28. The various pieces of jewelry are free to slide along the chain.

The female member 14 includes an opening which receives the male member 12 and further includes a locking mechanism 30 which is used for releasably locking the male member 12 within the female member 14. Typically, the female member of the jewelry clasp is of the type described in the aforementioned U.S. Pat. No. 4,001,923, whose specifications is incorporated herein by reference. Accordingly, it is not thought necessary to describe the details of the female member or the locking mechanism herein. However, it is understood that the female member and the locking mechanism of the aforementioned patent is preferably intended to be utilized. Alternately, other forms of female members and locking mechanisms within the state of the art could also be utilized.

Figure 2:
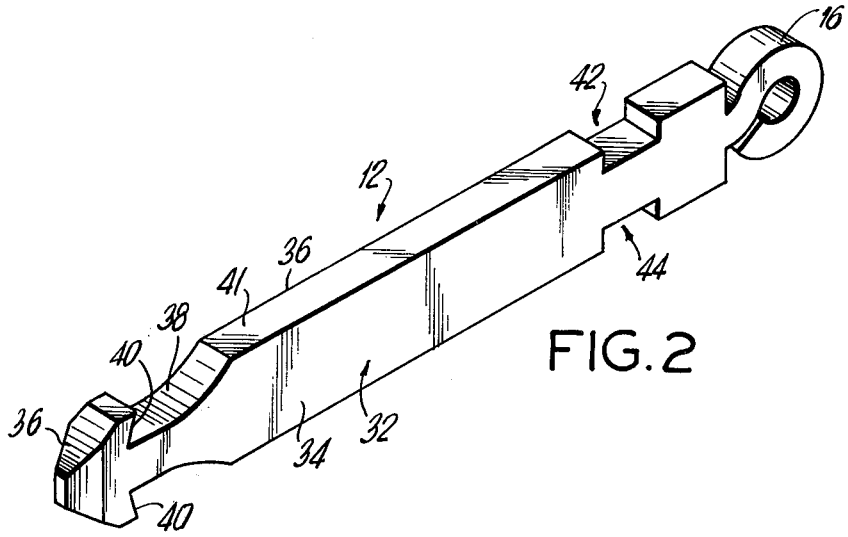
FIG. 2 is a perspective view of the male member of the jewelry clasp in accordance with the present invention.

Referring now to FIG. 2, the male member 12 will be described in more detail. The male member 12 is an elongated rod or plunger having a shank portion 32 provided with a substantially rectangular cross section and having the planar side surfaces 34, 36. The front section or end includes a beveled or chamfered nose portion 36, the loop or ring 16 being formed at its opposing end. Directly behind the nose portion 36 there is provided a reduced neck portion 38. The neck portion 38 is smallest in width immediately adjacent the nose portion 36 and tapers outwardly to its widest dimension spaced from the nose portion 36. The reduced neck portion 38 is typically formed by means of the undercuts 40 formed directly behind the nose portion 36 which is then tapered outward until it reaches the body section 41 of the shank portion 32.

The purpose of the undercut and reduced neck portion is for use in conjunction with the locking mechanism of the type described in the aforementioned patent. Though the beveled nose may be used to facilitate entry of the male member into the female member to thereby permit closing of the jewelry clasp, at the same time the beveled nose portion (1) facilitates use of the male member to thread the chain through additional pieces of jewelry, and (2) facilitates insertion through the retaining guard, as will hereinafter be described below.

Also provided on the male member 12 and adjacent the rear section thereof, between the body section 41 and the loop 16, are opposing notches 42, 44. Such notches 42, 44 are for use in conjunction with the retaining guard, as will be described hereinafter below.

Figure 3:
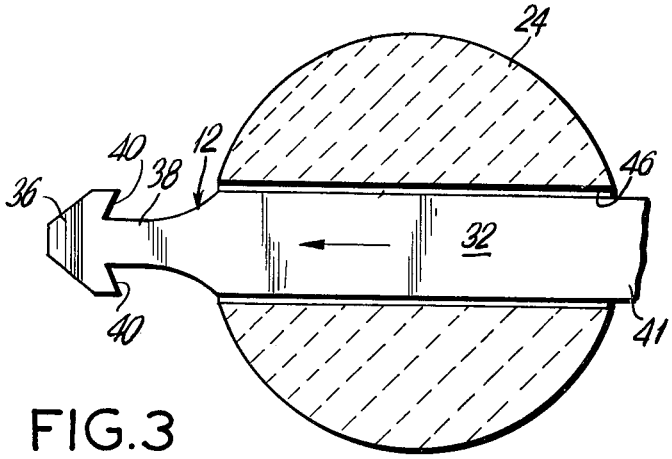
FIG. 3 is a side sectional view taken through a bead showing the male member being inserted through the opening in the bead.

In order to permit the addition of more pieces of jewelry onto the chain, as well as the removal of specific pieces of jewelry from the chain, the size of the male member is made smaller than the diameter of the openings in the various pieces of jewelry. As specifically shown in FIG. 3, the bead 24 includes an opening 46 extending therethrough. The male member 12, at its largest transverse dimension across the shank portion 32, is smaller than the diameter of the opening 46. In this way, the male member can be used as a guide for threading the chain 19 through the beads 24. By means of the beveled nose portion 36, the male member can easily enter into the opening 46 in the beads. Similarly, any other piece of jewelry which is held by means of a loop, such as the loop 28 of the tooth ornament 26, could also be added onto the chain by threading the male member through the loop. It is understood that the transverse size of the male member would also be less than the diameter of or opening through any loop used to hold other pieces of jewelry.

Figure 4:
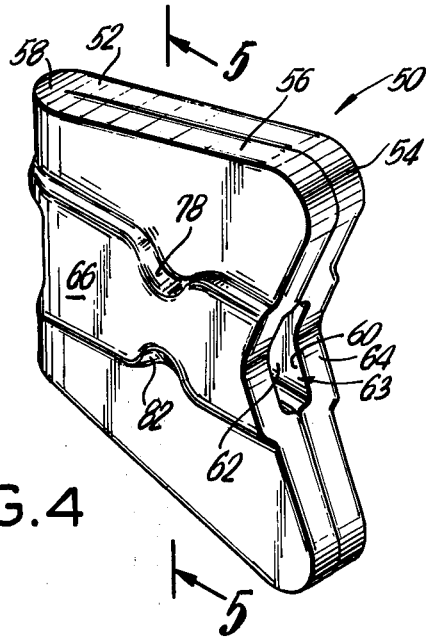
FIG. 4 is a perspective view of the retaining guard in accordance with the present invention.
Figure 8:
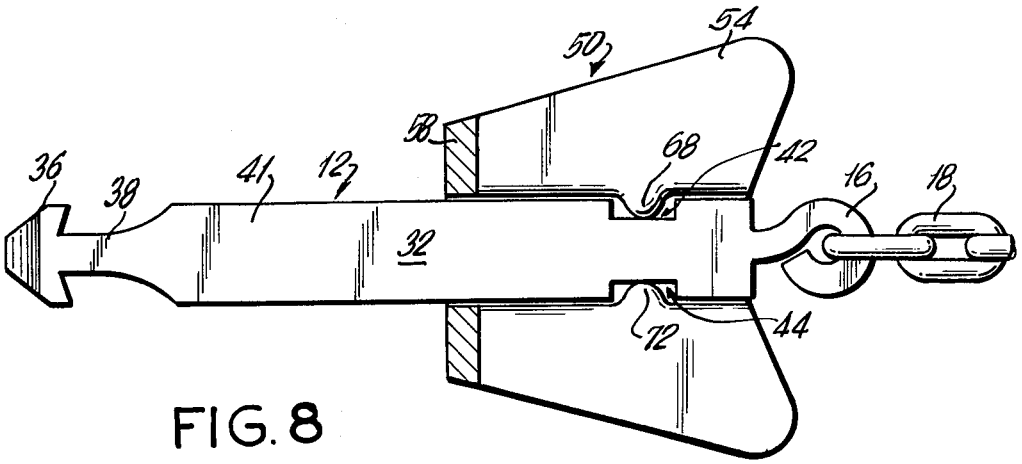
FIG. 8 is a sectional view showing the male member disposed within the retaining guard.

Although the use of the male member 12 to thread additional pieces of jewelry is an important consideration in using the jewelry clasp, the problem results in that these same pieces of jewelry can accidentally slide off the male member at any time when the jewelry clasp is opened, either when the jewelry clasp is intentionally opened by the user, or when the jewelry clasp is accidentally opened. In order to prevent such sliding off of the pieces of jewelry and loss thereof, there is provided in accordance with the present invention a retaining guard 50, as is best shown in FIGS. 1 and 4. The retaining guard 50 is releasably placed over the rear portion of the male member 12, as shown in FIG. 8, thus permitting the forward portion thereof to be free for use in association with the female member 14 to close the jewelry clasp.

The transverse dimension or height of the retaining guard 50 is larger than the diameter of the opening 46 in the pieces of jewelry, so that after the pieces of jewelry have been added onto the chain by threading the male member 12 therethrough, the retaining guard 50 when placed on the male member can prevent the jewelry from sliding off. In this manner, even when the jewelry clasp is opened so that the male member is separated from the female member, the retaining guard 50 will prevent the pieces of jewelry from sliding off the male member.

Figure 7:
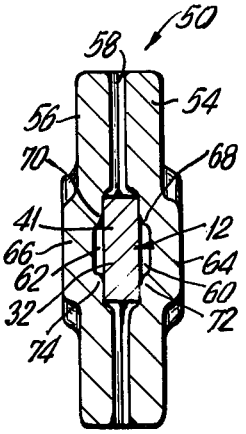
FIG. 7 is a view similar to FIG. 6 but showing the spreading of the retaining guard during insertion of the male member therein.
Figure 5:
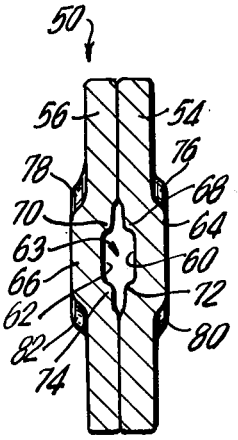
FIG. 5 is a side sectional view taken along lines 5—5 of FIG. 4.
Figure 6:
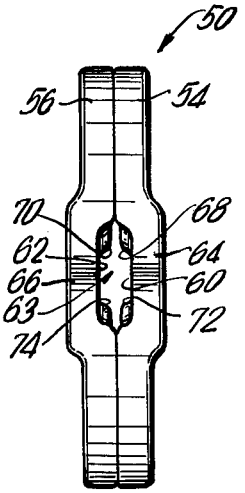
FIG. 6 is an end view of the retaining guard shown in FIG. 4.

The retaining guard 50 is a single piece of rigid material 52 which is folded over onto itself to form the confronting winged portions 54, 56 with the interconnecting bight portion 58 therebetween, so that the winged portions are resiliently biased toward each other. Recesses 60, 62 are formed on the inner surfaces of the confronting walls of the winged portions to thereby form a substantially rectangular channel 63 extending longitudinally therethrough. The channel 63 extends through the bight portion 58 so that it provides a passageway entirely through the retaining guard 50. The size of the channel is such that it can receive the male member 12 therein, as is best shown in FIGS. 7 and 8. The recesses 60, 62 can be formed by striking a central section of the winged portions to thereby form the protruding bulges 64, 66 in the outer walls of the winged portions 54, 56.

Angularly shaped projections are provided in the channel by forcing or pressing parts of the bulges 64, 66 into the channel 63 at upper and lower portions of the channel. Specifically the four inwardly directed projections include the upper two projections 68 and 70, and the projections 72, 74 formed in the lower two portions. As shown in the drawing, these four projections in the channel are obtained from the inwardly pressed parts or sections disposed on the outer walls of the bulges on the winged portions 54, 56, which include the upper two sections 76, 78 and the lower two sections 80, 82.

As stated above, the retaining guard 50 is formed of rigid material, and the folded over winged portions are such that they can resiliently separated under pressure. Thus, when the male member 12 is inserted into the channel 63, it proceeds until it reaches the inwardly directed projections 68, 70, 72, 74, where these projections restrict the size of the channel. As a result, the continued movement of the male member past the projections, will force the winged sections to separate, as shown in FIG. 7, thereby providing sufficient room in the channel for the male member 12 to pass through the rest of the channel. The beveled nose section 36 of the male member 12 is insertable between the upper projections 68, 70 and the lower projections 72, 74 to separate them, and thus facilitates spreading of the winged sections 54, 56. It is noted, that the section of the male member 12 shown in FIG. 7, is a portion of the body section 41 disposed after the neck portion 38 but before the notches 42, 44 of the rear section.

The male member continues to maintain the spread condition of the winged sections until the projections 68, 70 and 72, 74 reach the notches 42 and 44 formed in the rear section of the male member. The projections will then enter into the notches, as shown in FIG. 8, and the resilient winged sections will again close together onto the male member. The male member will then be held in place by means of the projections disposed in the notches, thus gripping or locking the male member within the retaining guard 50.

As shown in FIG. 8, the length of the male member 12 is such that when the male member is inserted into the retaining guard 50, the forward part of the male member is still available for entry into the female member 14, thereby providing the usual clasping action. At the same time, the retaining guard will be held in place on the rear section of the male member to prevent pieces of jewelry from sliding off the chain.

It is noted, that FIG. 8 indicates the male member was first inserted through the rear end of the retaining guard 50 between the winged portions 54, 56. However, the construction of the retaining guard 50 also permits the male member to be first inserted through the front end or bight portion 58 of the retaining guard, though not shown, where the retaining guard would function in the latter case in the same manner as set forth above.

When it is desired to remove pieces of jewelry, the male member can be removed from the retaining guard by pulling on a male member. The pressure will force the projections 68, 70 and 72, 74 out of the notches 42 and 44, and the body section 41 of the male member will engage the projections, thus forcing the winged portions apart so that the male member can be removed from the channel. When the male member has been removed, again the winged portions will close and return the retaining guard back to its normal state, shown in FIG. 4. Additional pieces of jewelry can then be added or removed, as desired, and subsequently the retaining guard is replaced in its position on the male member so that the jewelry clasp can be closed, as shown in FIG. 1.

The front end or interconnecting bight portion 58 of the retaining guard 50 additionally serves as a stop for the female member 14, as shown in FIG. 1. This provides an additional safety feature by preventing the male member 12 from continuing too far into the female member 14, therefore the retaining guard prevents the male member from damaging that part of the jewelry clasp.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A jewelry clasp comprising:

a female member having an opening therein;

a male member adapted to be inserted into said female member through said opening, said male member having notches therein;

releasable locking means for clamping said male and female members together; and means releasably engaging in said notches of said male member for preventing jewelry from sliding off said male member, said means including a retaining guard having a larger dimension than said male member.

2. A jewelry clasp as in claim 1, wherein said retaining guard includes a body portion having a longitudinal channel extending therethrough for receiving said male member therein, said body portion being provided with gripping means extending into said channel for engagement in said notches for releasably retaining said male member in said channel.

3. A jewelry clasp as in claim 2, wherein said gripping means includes projections extending from said body portion into said channel.

4. A jewelry clasp as in claim 3, wherein sidewalls of said channel are displaceable in a transverse direction to said longitudinal channel for facilitating insertion and removal of said male member from said channel.

5. A jewelry clasp as in claim 4, wherein said body portion is a piece of rigid material folded over onto itself to provide a pair of confronting winged portions connected by a bight portion.

6. A jewelry clasp as in claim 5, wherein said winged portions include confronting recesses provided in inner facing surfaces thereof to define said channel.

7. A jewelry clasp as in claim 6, wherein said winged portions are resiliently biased toward each other and separable to thereby releasably receive said male member.

8. A jewelry clasp as in claim 2, wherein said male member includes a shank portion with a nose section at one end thereof, said notches being provided in said shank portion adjacent an opposing end thereof, said notches being dimensioned to receive said gripping means when said male member is inserted into said retaining guard.

9. A jewelry clasp as in claim 8, wherein said body portion includes confronting winged portions, said winged portions being resiliently biased toward each other and separable under entry and removal pressure of said male member into said channel for thereby releasably receiving said male member into said channel, and wherein said gripping means includes projections to snap into said notches to releasably retain said male member in said channel.

10. A jewelry clasp as in claim 1, wherein said larger dimension of said retaining guard and a dimension of said female member are each greater than any chain receiving opening in pieces of jewerly being retained by said jewelry clasp, and wherein said retaining guard engages said female member to limit insertion of said male member into said female member.

* * * * *